US011056302B2

(12) United States Patent
Cho

(10) Patent No.: US 11,056,302 B2
(45) Date of Patent: Jul. 6, 2021

(54) COIL CONTROL DEVICE OF ELECTRONIC MAGNETIC CONTACTOR

(71) Applicant: LSIS CO., LTD., Anyang-si (KR)

(72) Inventor: Hyungeun Cho, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 94 days.

(21) Appl. No.: 16/586,283

(22) Filed: Sep. 27, 2019

(65) Prior Publication Data

US 2020/0294744 A1 Sep. 17, 2020

(30) Foreign Application Priority Data

Mar. 11, 2019 (KR) ..... 10-2019-0027726

(51) Int. Cl.

*H01H 47/24* (2006.01)
*H01H 47/00* (2006.01)
*H01H 47/32* (2006.01)
*H01H 50/44* (2006.01)

(52) U.S. Cl.

CPC ..... *H01H 47/001* (2013.01); *H01H 47/24* (2013.01); *H01H 47/32* (2013.01); *H01H 50/44* (2013.01)

(58) Field of Classification Search

CPC ..... H01H 47/24; H01H 47/32; H01H 47/001; H01H 50/44

See application file for complete search history.

(56) References Cited

U.S. PATENT DOCUMENTS 6,327,130 B1 12/2001 Durif et al.
6,775,114 B1 8/2004 Meid et al.
8,422,178 B2 4/2013 Pfingsten et al.
2008/0218928 A1* 9/2008 Baek ..... H01H 47/325 361/143
2017/0213677 A1* 7/2017 Yu ..... H01H 47/223
2018/0294120 A1* 10/2018 Lapiere ..... H01H 47/02

FOREIGN PATENT DOCUMENTS

JP S58164124 A 9/1983
JP S62145619 A 6/1987
JP 2004304314 A 10/2004

OTHER PUBLICATIONS

European Search Report for related European Application No. 19200483.6; action dated Apr. 2, 2020; (7 pages).
Japanese Office Action from corresponding Japanese Patent Application No. 2019-177658, dated Dec. 1, 2020.

* cited by examiner

*Primary Examiner* — Harry R Behm
(74) *Attorney, Agent, or Firm* — K&L Gates LLP

(57) ABSTRACT

A coil control device of an electronic magnetic contactor, comprises: an input power processing unit configured to convert and output an input power into a direct current power; an input voltage detecting unit configured to detect a voltage level of the direct current power outputted from the input power processing unit; a control unit configured to output a control signal for controlling current flowing in a coil using the voltage level detected by the input voltage detecting unit; and a switching unit configured to connect or cutoff the current flowing in the coil by switching according to the control signal from the control unit, wherein the control unit includes a gate driver electrically connected with the switching unit and configured to block noise from the coil.

4 Claims, 3 Drawing Sheets

COIL CONTROL DEVICE OF ELECTRONIC MAGNETIC CONTACTOR

CROSS-REFERENCE TO RELATED APPLICATION

Pursuant to 35 U.S.C. § 119(a), this application claims the benefit of earlier filing date and right of priority to Korean Application No. 10-2019-0027726, filed on Mar. 11, 2019, the contents of which is incorporated by reference herein in its entirety.

FIELD OF THE INVENTION

The present disclosure relates to a coil control device of an electronic magnetic contactor.

BACKGROUND OF THE INVENTION

In general, electronic magnetic contactors are devices that are connected to electrical connection routes in the system such as, buildings, factories, ships, etc. to provide or cutoff power to or from loads and prevent loads from being damaged. The electronic magnetic contactors are devices that use the principle of an electromagnet to open or close a contact using a certain power applied to the coil to make contact when the current flows, and when the current does not flow, the contact separated.

In the conventional system, there has been problem in that the circuit was complex, accumulated errors in operation, and the rate of defects in manufacturing was high, given that the number of parts in the analog system was high. To improve this, the conventional system replaced major parts of the existing analog method for generating PWM signals with the operation control unit 140 and the PWM controller 150 to reduce the incidence of failures and minimize power consumption.

FIG. 1 is a view illustrating a conventional electronic magnetic contactor.

Referring to FIG. 1, a coil control device of an electronic magnetic contactor includes an input power processing unit 110, an input voltage detecting unit 120, a constant voltage unit 130, an operation control unit 140, a PWM controller 150, a switching unit 160, and a surge absorption unit 170.

The input power processing unit 110 includes an input terminal 112, an input filter 114, and a rectifier 116.

The input filter 114 absorbs surge voltage inputted from the input terminal 112, and removes noise.

The input voltage detecting unit 120 detects a voltage level of a direct current power that is outputted from the rectifier 116.

The constant voltage unit 130 receives an input of a direct current power from the rectifier 116, and divides the voltage of the input direct current power to generate a constant voltage. Each of the parts is driven by the constant voltage from the constant voltage unit 130.

The operation control unit 140 includes a comparative judgment unit 142 and a time determination unit 144, compares the voltage level detected by the input voltage detecting unit 120 with the reference voltage level, and generates control signals according to a result of the comparison.

The PWM controller 150 receives feedback of the current flowing in the coil 300 and outputs the adjusted PWM signal by adjusting the pulse width of the PWM signal to control the current flowing in the coil 300 in accordance with the control signal generated by the operation control unit 140. The PWM controller 150 is an IC dedicated to PWM control.

The switching unit 160 is switched according to the PWM signal generated by the PWM controller 150 so that the current flowing in the coil 300 is energized or cut off.

The surge absorption unit 170 absorbs the reverse electromotive force generated when the current flowing in the coil 300 is energized or cut off.

As shown in FIG. 1, the conventional technologies have replaced many of the analog components with digital methods using PWM controller 150 to solve problems with conventional methods, but there are problems due to noise generated from the coils 300.

Specifically, noise (N) is generated from the coil 300 during operation of the coil control device 100 of the electronic magnetic contactors. Noise (N) is transmitted through the switching unit 160 to the PWM controller 150 for direct physical damage. As a result, the coil control device 100 of an electronic magnetic contactor may malfunction or be destroyed due to noise (N).

SUMMARY OF THE INVENTION

Therefore, an aspect of the detailed description is to provide a coil control device of an electronic magnetic contactor, capable of reducing the number of parts for driving a coil of the electronic magnetic contactor and preventing its malfunctions and damages due to noise from the coil.

Another aspect of the detailed description is to provide a coil control device of an electronic magnetic contactor that can implement desired performances in a coil control without a hardware modification.

To achieve these and other advantages and in accordance with the purpose of this specification, as embodied and broadly described herein, a coil control device of an electronic magnetic contactor includes: an input power processing unit configured to convert and output an input power into a direct current power; an input voltage detecting unit configured to detect a voltage level of a direct current power output from the input power processing unit; a control unit configured to output a control signal for controlling current flowing in a coil using the voltage level detected by the input voltage detecting unit, and a switching unit configured to connect or cutoff the current flowing in the coil by switching according to the control signal from the control unit.

The control unit may include a gate driver electrically connected with the switching unit and configured to block noise from the coil.

The control unit may further include a microcontroller that compares the voltage level detected by the input voltage detecting unit with a preset reference level and generates a PWM signal according to a result of the comparison, and the gate driver is configured to amplify the PWM signal and transmit the amplified PWM signal to the switching unit.

The gate driver may be a photo coupler.

The drive unit may further include a flywheel unit connected in parallel with both ends of the coil.

The flywheel unit may be a Schottky diode.

The coil control device of the electronic magnetic contactor in accordance with the present disclosure may replace the existing analog components through the control unit, thereby having a minimized size.

In the detailed description, noise generated by the coil is cut off by the gate driver owing to the structure that the control signal is transmitted to the switching unit through the gate driver, thereby preventing malfunctions and damages of the coil control device, and increasing the reliability of a coil control.

In addition, the control unit of the present disclosure can control coils of several different electronic magnetic contactors of different specifications by using one coil control device, with a software modification, thereby achieving desired performances without any modification of the configuration of the coil control device including microcontrollers.

DETAILED DESCRIPTION OF THE INVENTION

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

A coil control device of an electronic magnetic contactor in accordance with the present disclosure is capable of having a minimized size by replacing the existing analog components, and is capable of enhancing the reliability of a coil control by preventing its malfunctions and damages due to noise from a coil.

The present disclosure also allows coils of several different electronic contactors of different specifications to be driven by a single coil control device, thereby achieving desired performances by a software modification alone without any change in the configuration of the coil control device.

Hereinafter, description will be given in detail of the coil control device 200 of the electronic magnetic contactor in accordance with the present disclosure with reference to the attached drawings.

Figure 1:
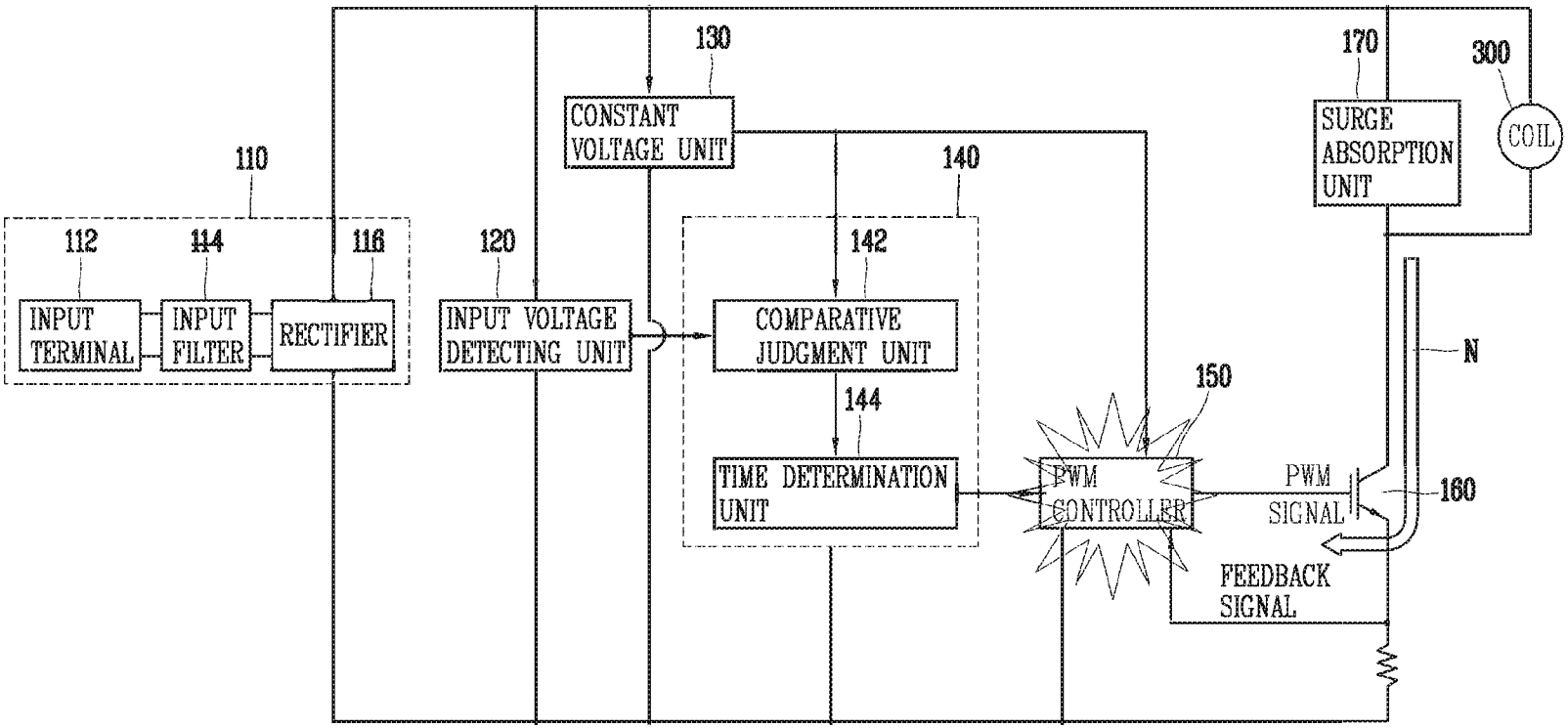
FIG. 1 PRIOR ART
FIG. 1 is a circuit diagram illustrating a conventional coil control device of an electronic magnetic contactor.
Figure 2:
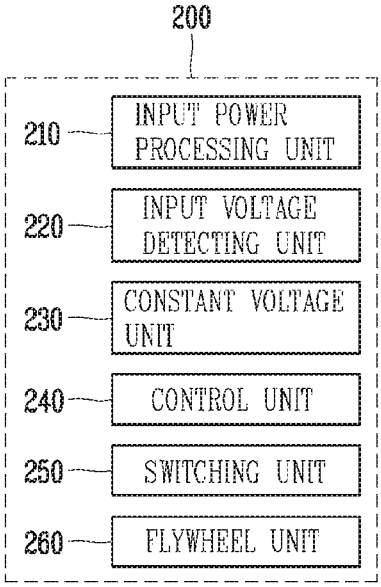
FIG. 2 is a diagram illustrating a coil control device of an electronic magnetic contactor in accordance with an embodiment of the present disclosure.

FIG. 2 is a diagram illustrating a coil control device of an electronic magnetic contactor in accordance with an embodiment of the present disclosure.

Referring to FIG. 2, the coil control device 200 of an electronic magnetic contactor in accordance with the present disclosure may include an input power processing unit 210, an input voltage detecting unit 220, a constant voltage unit 230, a control unit 240, a switching unit 250, and a flywheel unit 260.

The input power processing unit 210 converts power input to the coil control device 200 into a direct current power and outputs the converted power. Specifically, the input power processing unit 210 may include an input terminal 212, an input filter 213, and a rectifier 214.

The input filter 213 absorbs surge voltage of the power input to the input terminal 212 and removes noise. The input filter 213 may be an EMC filter. Not limited to this, however, the input filter 213 may be implemented with other types of filters that can block electromagnetic interference (EMI) that may interfere with control of the coil 300 through the coil control device 200.

The rectifier 214 is configured to rectify the power output from the input filter 213 and outputs it with direct current power.

The input voltage detecting unit 220 is configured to detect the voltage level of the DC power output from the input power processing unit 210.

The constant voltage unit 230 receives the direct current power output from the input power processing unit 210 and generates constant voltage. Specifically, the constant voltage unit 230 divides the direct current power output from the rectifier 214 and outputs a constant voltage. The control unit 240 is driven by the constant voltage output from the constant voltage unit 230. A second constant voltage unit 231 outputs a voltage to drive a microcontroller 241 of the control unit 240.

The control unit 240 outputs a control signal for controlling the current flowing in the coil 300 using the voltage level detected by the input voltage detecting unit 220. Specifically, the control unit 240 outputs the control signal based on a comparison result by comparing the voltage level detected by the input voltage detecting unit 220 with the preset reference level.

The control unit 240 may include a microcontroller unit (MCU) 241 and a gate driver 242.

The microcontroller 241 generates a control signal according to the comparison result by comparing the voltage level detected by the input voltage detecting unit 220 with the preset reference level and transmits it to the gate driver 242.

Hereinafter, description will be given in detail of generation of control signals of the microcontroller 241.

The microcontroller 241 outputs a suction signal as the control signal when the voltage level detected by the input voltage detecting unit 220 is greater than the preset reference level.

The suction signal corresponds to a signal intended to allow current to flow through the coil 300 for contact with the contacts of the electronic magnetic contactor. The microcontroller 241 outputs a suction signal that causes a large current (e.g., 250 mA) to flow until the contact is made, and only needs to remain in contact after contact, so outputs a suction signal to allow a relatively low current (e.g., 30-60 mA) to flow.

The microcontroller 241 outputs a release signal as the control signal when the voltage level detected by the input voltage detecting unit 220 is lower than the preset reference level. The release signal is a signal to cut off the current flowing in the coil 300 to release contact with the contacts of the electronic magnetic contactor.

The control signal may be a PWM signal. The preset reference level may vary depending on the specification or the performance of the coil 300 to be controlled.

The gate driver 242 receives the control signal from the microcontroller 241 and transmits it to the switching unit 250. According to one embodiment, the gate driver 242 may be implemented by an insulated gate to cutoff noise generated from the coil 300.

According to one embodiment, the gate driver 242 may be implemented as a photo coupler. The photo coupler refers to an optical composite device built into a package that optically combines a light-emitting element and a light-receiving element for the purpose of transmitting electrical signals between circuits in an electrically insulated state.

Since the gate driver 242 implemented as a photo coupler uses light to transmit signals through the light-emitting element and the light-receiving element, in the absence of a signal, the microcontroller 241 connected to the input terminal and the switching unit 250 connected to the output terminal are physically isolated. Thus, the gate driver 24) can more effectively prevent the effects of noise from the coil 300 on the microcontroller 241, depending on the operation of the coil control device 200.

The switching unit 250 switches according to the control signal output from the control unit 240 to turn on or cut off the current flowing in the coil 300. Specifically, the switching unit 250 is turned on to allow current to flow in the coil 300 when the control signal is the suction signal, and the coil 300 is turned off when the signal is the release signal. The switching unit 250 may be implemented as MOSFET or BJT. Not limited to this, however, the switching unit 250 may be implemented as other type of transistors capable of switching operation using signals input to the gate electrode (control terminal).

The flywheel unit 260 absorbs the reverse electromotive force produced by the coil 300.

Specifically, the flywheel unit 260 is connected in parallel to both ends of the coil 300 and forms a loop so that the current generated by the reverse electromotive force caused by the interruption of the current flowing in the coil 300 does not affect other elements in the coil control device 200.

The flywheel unit 260 may be implemented as a Schottky diode. Not limited to this, however, the flywheel unit 260 may be implemented with other types of diodes with low forward voltage and fast switching speed.

As described above, the coil control device 200 of an electronic magnetic contactor in accordance with the present disclosure uses a micro controller 241 to generate a control signal, and the analog parts used are reduced compared to the conventional device using PWM controllers. Therefore, the power consumed is reduced.

In addition, in the conventional device, it is required to change the configurations inside the device to a configuration with different capacities or numerical values depending on the specification or characteristics of the coil 300, whereas in the present disclosure, the performance of the coil 300 can be achieved by modifying the values set in the microcontroller 241 from the software side. Therefore, it is possible to control the coil 300 of different electronic contactors with different specifications on one device 200, which increases general availability and facilitates maintenance.

In addition, the coil control device of the present disclosure has the structure in which the control signal generated by the microcontroller 241 is transmitted to the switching unit 250 through the gate driver 242, and noise caused by reverse electromotive force generated by the coil 300 is blocked from affecting the micro controller 241. Therefore, it can prevent malfunctions and damages in advance caused by noise from the coil 300 to ensure reliability of the control of the coil 300 of the coil control device 200.

Figure 3:
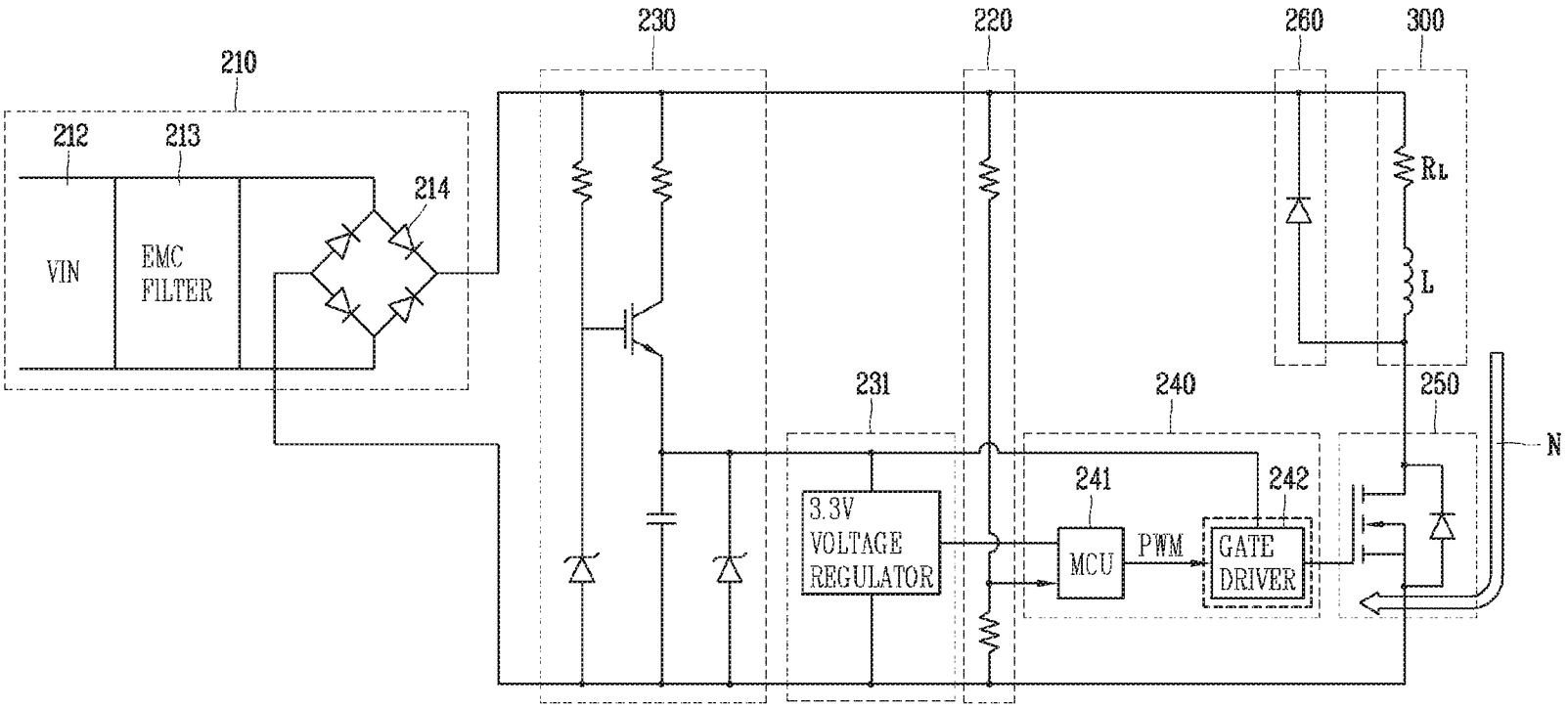
FIG. 3 is a circuit diagram illustrating a coil control device of an electronic magnetic contactor in accordance with an embodiment of the present disclosure.

FIG. 3 is a circuit diagram illustrating a coil control device of an electronic magnetic contactor in accordance with an embodiment of the present disclosure.

Referring to FIG. 3, the input filter 213 in the input power processing unit 210 is implemented with an EMC filter and the rectifier 214 with four diodes. The constant voltage unit 230 is implemented with two resistors, one capacitor and two zenor diodes. The second constant voltage part 231 is implemented as a voltage regulator. The voltage output of the second constant voltage part 231 is not limited to 3.3 V and can be implemented as a regulator that outputs a voltage that meets the specifications of the microcontroller (MCU) 241.

The voltage detecting unit 220 is implemented with two resistors. The voltage detecting unit 220 distributes the constant voltage output from the constant voltage unit 230 using two resistors and the voltage applied to the lower resistance is applied to the microcontroller 241.

The microcontroller 241 is operated using the voltage output from the second constant voltage part 231 and compared with the voltage level set by the voltage detecting unit 220 to generate a control signal (PWM signal) according to the comparison result and output it to the gate driver 242.

The gate driver 242 is implemented as a photo coupler. The gate driver 242 transmits the control signal of the microcontroller 241 to the switching unit 250.

According to one embodiment, the gate driver 242 may amplify and transmit control signals from the microcontroller 241.

The switching unit 250 is turned on or off according to the control signal from the gate driver 242. The switching unit 250 is implemented as a MOSFET.

The flywheel unit 260 absorbs the reverse electromotive force produced by the coil 300. The flywheel unit 260 is implemented as a diode.

Hereinafter, description will be given specifically of the noise (N) generated by the coil 300. When the coil 300 is switched off, that is, the current is cut off, the presence of the inductor (L) component results in a reverse electromotive force. the reverse electromotive force is absorbed by the flywheel unit 260, but due to parasitic capacitors present in the switching unit 250, part of the reverse electromotive force may be transmitted to each configuration of the coil control device 200 and act as noise.

Unlike the conventional art, the coil control device 200 of the electronic magnetic contactor in accordance with the present disclosure has a gate driver 242 between the microcontroller producing the control signal 241 and the switching unit 250 receiving the control signal.

The gate driver 242 is implemented as a photo coupler and physically insulates the microcontroller 24) and the switching unit 250. Therefore, the noise (N) generated by the reverse electromotive force generated by the off operation of the coil 300 is cut off by the gate driver 242, which prevents malfunction and damages of the coil control device 200.

It should also be understood that the above-described embodiments are not limited by any of the details of the foregoing description, unless otherwise specified, but rather should be construed broadly within its scope as defined in the appended claims, Therefore, all changes and modifications that fall within the metes and bounds of the claims, or equivalents of such metes and bounds are therefore intended to be embraced by the appended claims.

What is claimed is:

1. A coil control device of an electronic magnetic contactor, comprising:

an input power processing unit configured to convert and output an input power into a direct current power;

an input voltage detecting unit configured to detect a voltage level of the direct current power outputted from the input power processing unit;

a control unit configured to output a control signal for controlling current flowing in a coil using the voltage level detected by the input voltage detecting unit; and a switching unit configured to connect or cutoff the current flowing in the coil by switching according to the control signal from the control unit, wherein the control unit includes a microcontroller that compares the voltage level detected by the input voltage detecting unit with a preset reference level and generates a PWM signal according to a result of the comparison, and a gate driver receives the PWM signal from the microcontroller and transmits it to the switching unit and is configured to block noise from the coil, wherein the gate driver is a photo coupler, and in the absence of a signal, the microcontroller and the switching unit are physically isolated, and wherein the microcontroller outputs a suction signal as the PWM signal when the voltage level detected by the input voltage detecting unit is greater than the preset reference level, and the microcontroller outputs a release signal as the PWM signal when the voltage level detected by the input voltage detecting unit is lower than the preset reference level.

2. The coil control device of claim 1, wherein the gate driver is configured to amplify the PWM signal and transmit the amplified PWM signal to the switching unit.

3. The coil control device of claim 1, further comprising a freewheeling unit connected in parallel with both ends of the coil.

4. The coil control device of claim 3, wherein the freewheeling unit is a Schottky diode.

* * * * *